United States Patent [19]

Lee, Jr.

[11] 4,132,360

[45] Jan. 2, 1979

[54] PULSATING HAIR DRYER

[75] Inventor: Lawrence J. Lee, Jr., Huntington, Conn.

[73] Assignee: General Electric Company, Bridgeport, Conn.

[21] Appl. No.: 826,416

[22] Filed: Aug. 22, 1977

[51] Int. Cl.[2] ..... B05B 1/08

[52] U.S. Cl. ..... 239/383; 219/373

[58] Field of Search ..... 34/97, 243 R; 239/101, 239/102, 222.21, 222.17, 383, 382, 381, 463, 214; 219/368, 373, 380

[56] References Cited

U.S. PATENT DOCUMENTS

| | | | |
|---|---|---|---|
| 1,124,399 | 1/1915 | Earle | 239/222.17 |
| 2,079,044 | 5/1937 | Santmyer | 416/19 |
| 2,129,939 | 9/1938 | Juul | 416/19 |
| 2,878,066 | 3/1959 | Erwin | 239/383 X |
| 3,473,736 | 10/1969 | Heitzman | 239/101 |
| 3,860,174 | 1/1975 | Cercone | 34/97 X |
| 3,921,651 | 11/1975 | Weihe, Jr. | 239/383 |
| 4,019,260 | 4/1977 | Levy et al. | 34/97 |

FOREIGN PATENT DOCUMENTS

| | | | |
|---|---|---|---|
| 362658 | 7/1962 | Switzerland | 239/383 |

*Primary Examiner*—John J. Love

*Attorney, Agent, or Firm*—John F. Cullen; George R. Powers; Leonard J. Platt

[57] ABSTRACT

A pulsating attachment for use with an electric hair dryer that has a tubular end through which air is expelled is described comprising a coupling section with an asymmetrical and unbalanced single impeller supported in the coupling for rotation therein and mounting structure connecting the coupling and the tubular end whereby the expelled air rotates the impeller and, due to its unbalanced mounting, creates a pulsating flow of air at a constant flow rate from the coupling. This results in a rotating path of pulsating air on the head of the user to create a fluffing action.

5 Claims, 5 Drawing Figures

PULSATING HAIR DRYER

BACKGROUND OF THE INVENTION

1. Field of the Invention

The invention relates to an attachment for a pistol-type hair dryer which attachment causes a pulsating effect of expelled air at a constant flow rate to result in fluffing of the hair of the user.

2. Description of the Prior Art

In a typical form of hair drying a pistol or tubular type dryer is used where unheated air is expelled at various rates of flow and levels of heat to dry and style the hair of the user. The dryer is generally manipulated by the user to cover the head to insure even, quick, drying and styling, and fluffing of the hair. Various devices provide such drying by using an air stream in a conduit which may employ a shaped outlet or use attachments. The attachments may direct the air or shape it or break it into streams all designed to enhance the drying action. Since the advent of massagers in showers to create a pulsing action in the water, the same concept has been applied to hair dryers by varying the magnitude of the flow rate of the existing air such as by a rudder-like arrangement in the air stream to create pulsations for causing fluffing. This has the advantage of fluffing the hair but changes the amount of air reaching the hair depending on the position of the means that impede the air flow. Also, it can have a small effect of back pressure on the dryer's air impeller which can be reflected in the size of the motor needed to drive the impeller since the motor needs to be powerful enough to move the air at the maximum blockage of the exit conduit. While this effect is small, it does introduce another variable in the design. A typical pulsating arrangement of this type is shown in U.S. Pat. No. 4,019,260.

It is the main object of the invention to provide an improved pulsating arrangement wherein the exit flow is at a constant rate at all times.

Another object is to provide such a pulsating device which move the air stream in a spiral action to automatically trace an oval or circle on the head of the user.

Another object is to provide such a pulsator which uses a unique asymmetrical and unbalanced impeller that is selfpropelled and creates a pulsating spiralling effect.

SUMMARY OF THE INVENTION

In accordance with the invention, a pulsating attachment is disclosed for use with an electric hair dryer having a tubular end through which air is expelled, the pulsator being attachable to the tubular conduit and comprising a separate coupling section with a hub centrally therein and strut means supporting the hub. Mounted on the hub is an asymmetrical and unbalanced single impeller supported for rotation as a single fan blade blocking preferably about one quarter of the exit area at all times. Mounting means connect the coupling in the conduit to the tubular end. The expelled air rotates the impeller or fan blade creating a pulsating spiral flow of air at a constant flow rate from the coupling to trace a circular or oval path on the head of the user. Thus, the main object of the invention is to provide a pulsating attachment for a pistol-type hair dryer that expels a constant flow rate of air in a pulsating and spiral fashion.

DESCRIPTION OF THE PREFERRED EMBODIMENT

The invention is described in connection with a pistol-type hair dryer although it is applicable to any conduit-type hair dryer wherein a barrel tube 10 either circular or oval is supported by handle 12 with the tube containing an internal fan and heating means controlled by suitable switches to expel air, usually heated at selected levels, out the end of the tube 10 all in a known manner. Various attachments to direct the air flow or shape it are available for such dryers. In accordance with the invention, an improved attachment in the form of coupling 14 clamps on the end of tube 10 in any suitable manner such as a peripheral recess 16 on the coupling outer surface at its upstream end so that it can be quickly slid into the end of tube 10 and held by frictional engagement inside the tube such a coupling being shown in FIG. 3. Thus, all air exiting tube 10 must pass through coupling 14.

Figure 1:
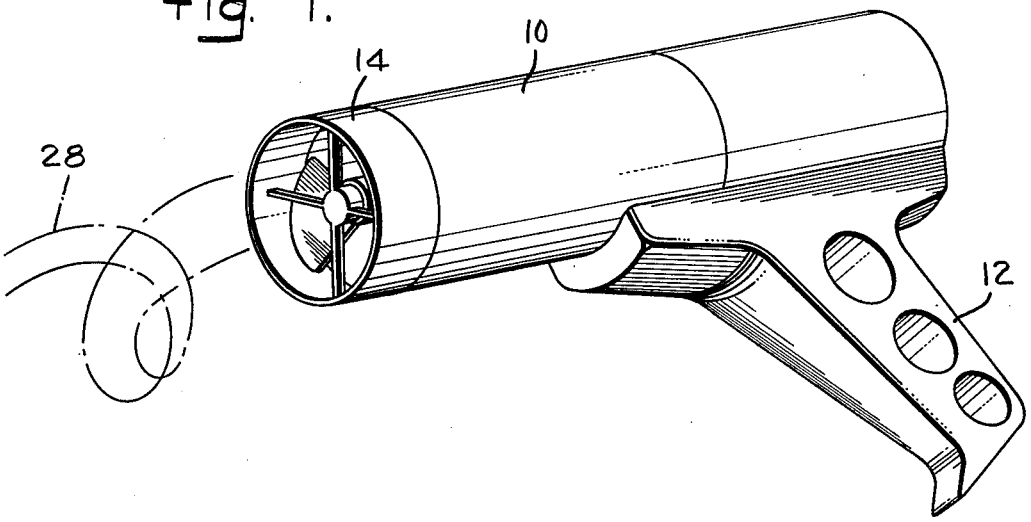
FIG. 1 is a perspective of a typical pistol hair dryer showing the attachment of the invention.
Figure 2:
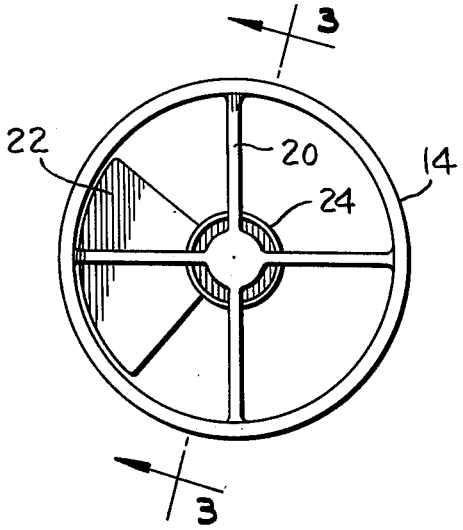
FIG. 2 is an end view of the attachment.
Figure 3:
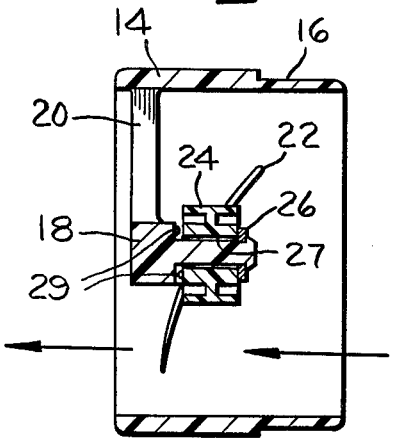
FIG. 3 is a cross-sectional view on line 3—3 of FIG. 2.
Figure 4:
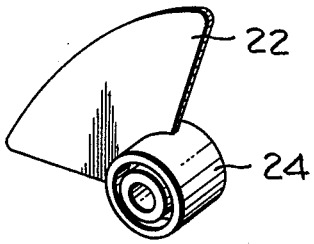
FIG. 4 is a perspective of the asymmetrical and unbalanced single fan blade.
Figure 5:
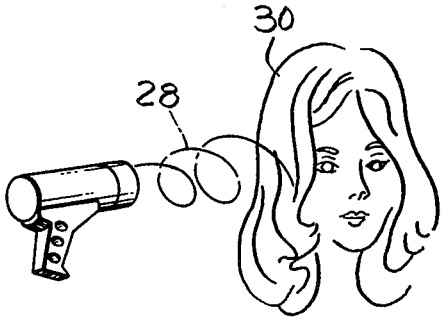
FIG. 5 is a perspective showing the pulsating and spiral path created by the attachment.

For handling the air to create a pulsating spiral air stream that is stimulating to the scalp and provide a fluffing action on the hair, coupling 14 is provided with a hub 18 disposed centrally of tube 10 and held by struts 20 as shown in FIGS. 2 and 3. To create pulses in the exiting air, a single asymmetrical fan blade 22 is mounted on its own hub 24 as shown in FIG. 4. The type of off-balanced or one-sided fan structure of FIG. 4 is an inherently unbalanced arrangement. Hub 24 cooperates with hub 18 and is held on by suitable means such as C-clamp 26 for rotation of impeller 22 on strut supported hub 18. The inherent unbalance may be further enhanced by making a deliberate relatively loose fit 27 between the hubs 18 and 24 to ensure an unbalanced situation and permit a wobble or long enough pulse duration to be perceived by the user. While not necessary, an alternate form to ensure the wobble may be a suitable bump 29 or equivalent on one or both hubs. Generally, all the parts will be plastic and it can be seen that air flow in the direction of the arrows shown in FIG. 3 rotates the impeller or fan blade assembly causing it to wobble or rotate. This creates a pulsating effect in the exit flow as it rotates to alternately block part of the flow in a continuous circular path. However, since the impeller 22 is always in the air stream the exit from tube 10 is a constant flow thus reducing any back pressure on the internal dryer fan. This continuous circular blocking by blade 22 resulting in pulses out the end of tube 10 also causes a spiral flow as diagramatically shown at 28 in FIGS. 1 and 5.

Since the flow is alternately thrown from one side of tube 10 to the other in a circular path or spiral fashion it will be apparent that the flow is received by the hair 30 of the user in a circular or oval path depending on how the dryer is aimed. This means that higher temperatures may be used since the temperature of the air is never concentrated at one spot but constantly rotates or traverses the user's head. The result of the action created by the unbalanced fan construction is a constant flow rate that reaches the user in pulses and in a spiral path creating a stimulating effect to the scalp and allowing the user to tolerate higher air temperatures at high velocities. Additionally, it tends to fluff the hair to insure even and quick drying. It has been found desirable that the single fan blade 22 be disposed to block about one quarter of the exit area from the tubular end at all times. While not absolutely necessary, this covering of a minimum of substantially one quarter of the exit area assists in unbalanced rotation of fluttering of the fan blade while creating the desirable pulsations and spiral effect on the user.

Thus, I have disclosed an attachment for a hair dryer which uses a constant flow but breaks it into a pulsating and spiral flow that is stimulating, tolerates higher air temperatures and velocities and fluffs the hair to insure even and faster drying.

While I have hereinbefore shown a preferred form of the invention, obvious equivalent variations are possible in light of the above teaching, it is therefore to be understood that, within the scope of the appended claims, the invention may be practiced otherwise than as specifically described, and the claims are intended to cover such equivalent variations.

I claim:

1. A pulsating attachment for use with an electric hair dryer having a tubular end through which air is expelled comprising, a coupling section, an asymmetrical unbalanced single impeller supported in said coupling for rotation therein, and mounting walls connecting said coupling and tubular end, whereby the expelled air rotates said impeller creating a pulsating spiral flow of air at a constant flow rate from the coupling.

2. Apparatus as described in claim 1 wherein said coupling comprises a clylindrical tube, a hub disposed centrally of the tube, strut means supporting the hub, and said impeller comprising a single fan unbalanced blade supported for rotation on said hub.

3. Apparatus as described in claim 2 wherein said single fan blade is disposed upstream of the struts.

4. Apparatus as described in claim 3 wherein said tubular coupling has a peripheral recess on its outer surface at its upstream end for quick disconnect frictional engagement inside said dryer tubular end.

5. Apparatus as described in claim 3 wherein said single fan blade is disposed to block substantially one quarter of the exit area from said tubular end at all times.

* * * * *